US006957985B1

(12) United States Patent
Wang

(10) Patent No.: US 6,957,985 B1
(45) Date of Patent: Oct. 25, 2005

(54) BLIND MATING ELECTRICAL CONNECTOR

(75) Inventor: Wei Che Wang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/102,087

(22) Filed: Apr. 7, 2005

(30) Foreign Application Priority Data

Jun. 29, 2004 (CN) ..... 200420062317X U

(51) Int. Cl.[7] ..... H01R 13/64
(52) U.S. Cl. ..... 439/680; 439/677
(58) Field of Search ..... 439/680, 674, 439/677, 607, 681

(56) References Cited

U.S. PATENT DOCUMENTS 3,594,696 A * 7/1971 Witek, Jr. ..... 439/680
3,873,172 A * 3/1975 Paullus ..... 439/680
4,403,824 A * 9/1983 Scott ..... 439/680
5,466,171 A 11/1995 Bixler et al.
5,588,876 A * 12/1996 Hayes et al. ..... 439/680
5,865,651 A * 2/1999 Dague et al. ..... 439/680
6,371,810 B1 * 4/2002 Iwasaki ..... 439/607
6,565,390 B2 5/2003 Wu
6,832,929 B2 * 12/2004 Garrett et al. ..... 439/680

* cited by examiner

*Primary Examiner*—Tho D. Ta
(74) *Attorney, Agent, or Firm*—Wei Te Chung

(57) ABSTRACT

An electrical connector (1) includes an insulative housing (10) having a rectangular mating portion (101). The mating portion has a receptacle (131) and an island (142) projecting from a middle of the receptacle. The receptacle has a generally rectangular cross-section defining opposite first and second sides running longitudinally along the housing. The receptacle has a pair of flattened corners (132) on the second side thereof so that the receptacle is in fact a polarizing hexagonal receptacle for allowing a complementary connector to insert therein only in a given orientation.

4 Claims, 6 Drawing Sheets

BLIND MATING ELECTRICAL CONNECTOR

BACKGROUND OF THE INVENTION

1. Field of the Invention

The present invention is related to an electrical connector, and more particularly to a blind mating electrical connector having an improved polarization means.

2. Description of Prior Art

Generally, many electrical connector assemblies include mateable male and female connectors. For preventing the connectors from being mated in an incorrect orientation, having a polarizing system in an electrical connector assembly is essential to ensure correct mating between the male and the female connectors. Some prior art connector assemblies have blind mating projections having different structures on one connector and complementary receptacles or apertures in the other connector for engaging with corresponding projections in order to polarization.

U.S. Pat. No. 6,565,390 B2 and U.S. Pat. No. 5,466,171 each disclose such an electrical connector assembly. The electrical connector assembly includes first and second connector mated with each other. The first connector has a pair of first and second polarizing posts projecting from two opposite ends thereof and having different configurations. The second connector defines an elongated polarizing receptacle extending longitudinally and the receptacle includes first and second ends which are different in structure. The first end of the receptacle of the second connector is dimensioned to receive the first polarizing post of the first connector, while the second end of the receptacle of the second connector is dimensioned to receive the second polarizing post of the first connector. The first end of the receptacle of the second connector is too small to receive the second polarizing post of the first connector, so the first connector and the second connector are mated only in a given orientation. Although the electrical connector assembly solve a blind mating problem, it is no doubt that the polarizing means having the polarizing posts increases the whole length of the electrical connector since the polarizing posts are disposed at opposite outer ends of a mating portion of the first connector, thereby making against the miniaturized development of the electrical connector.

Hence, it is desirable to provide an electrical connector having an improved polarization means to overcome the above-mentioned disadvantages of the prior arts.

SUMMARY OF THE INVENTION

A major object of the present invention is to provide a blind mating electrical connector having an improved polarization means without prolonging the length of the electrical connector.

In order to achieve the object set forth, an electrical connector in accordance with the present invention comprises an insulative housing having a rectangular mating portion, a shielding shell attached to the insulative housing, and a plurality of terminals arranged in four rows and received in the insulative housing. The mating portion includes opposite top and bottom walls, and a pair of side walls connecting with the top and the bottom walls, which together define a receptacle therebetween. An island projects forwardly from a middle of the receptacle. A plurality of passageways are defined in the top and the bottom walls and opposite side surfaces of the island. The receptacle has a generally rectangular cross-section defining opposite first and second sides running longitudinally along the housing. The receptacle has a pair of flattened corners on the second side thereof so that the receptacle is in fact a polarizing hexagonal receptacle for allowing a complementary connector to insert therein only in a given orientation.

Other objects, advantages and novel features of the invention will become more apparent from the following detailed description of the present embodiment when taken in conjunction with the accompanying drawings.

DETAILED DESCRIPTION OF THE INVENTION

Reference will now be made in detail to the preferred embodiment of the present invention.

Figure 1:
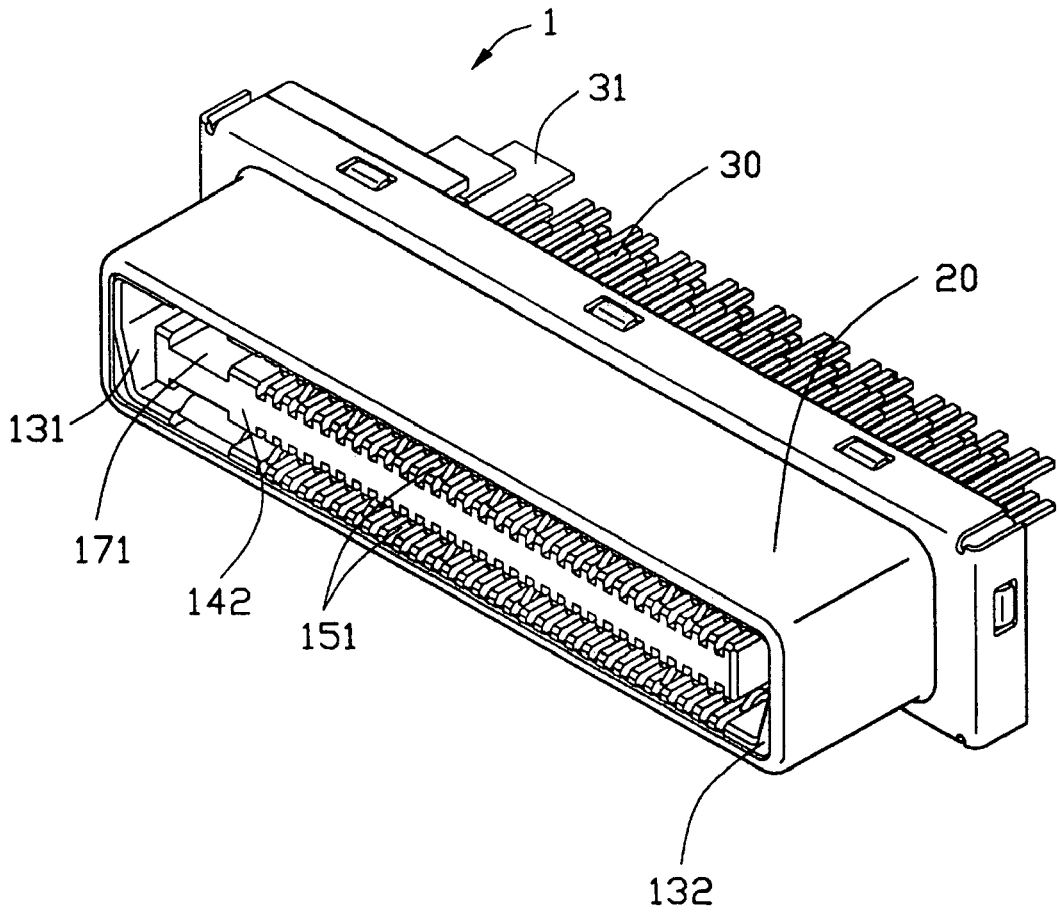
FIG. 1 is an assembled, perspective view of an electrical connector in accordance with the present invention.

Referring to FIG. 1, an electrical connector 1 in accordance with the present invention comprises an insulative housing 10, a shielding shell 20 attached to the insulative housing 10, and a plurality of first and second terminals 30, 31 arranged in four rows and received in the insulative housing 10 respectively for transmitting signal and power.

Figure 2:
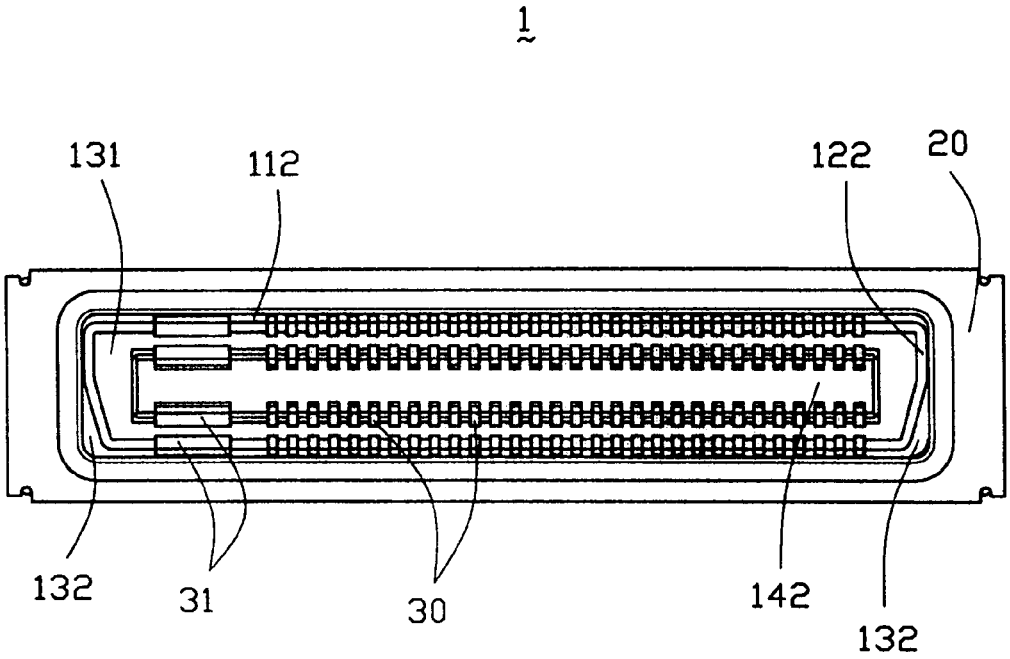
FIG. 2 is a front plane view of the electrical connector of FIG. 1.
Figure 3:
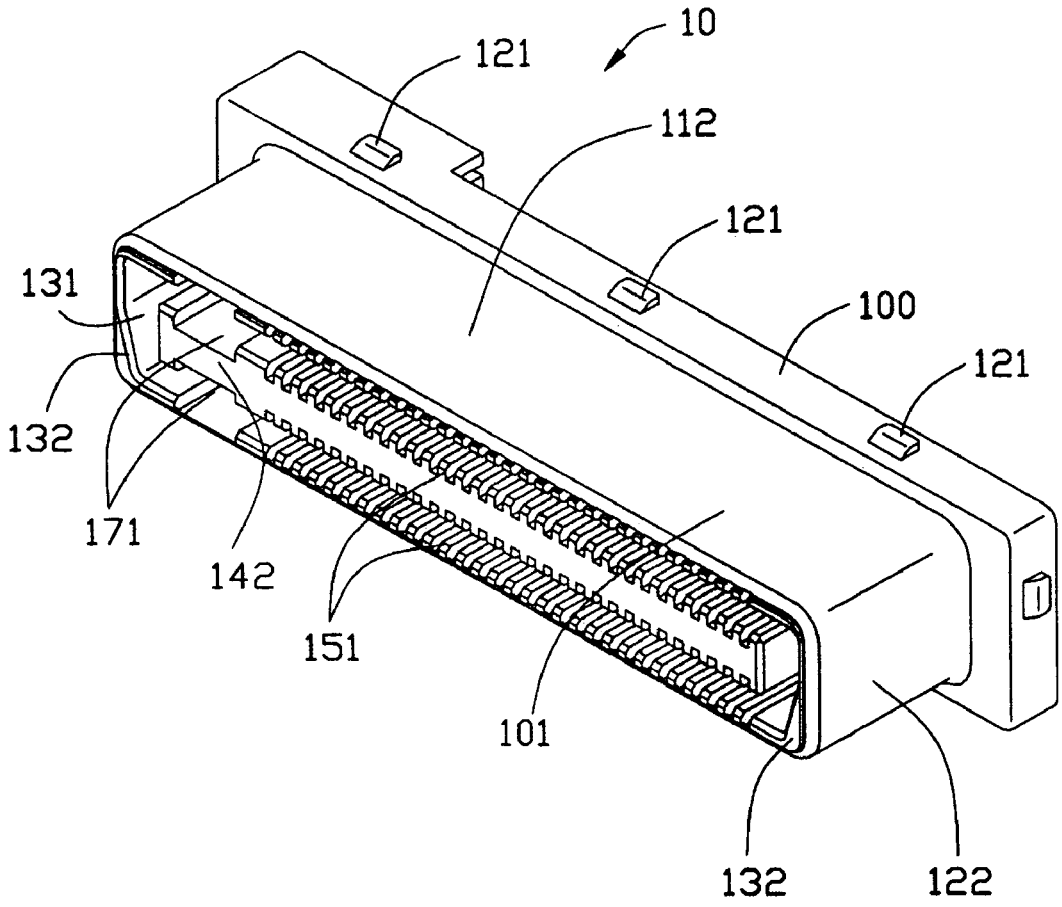
FIG. 3 is a perspective view of an insulative housing of FIG. 1.
Figure 4:
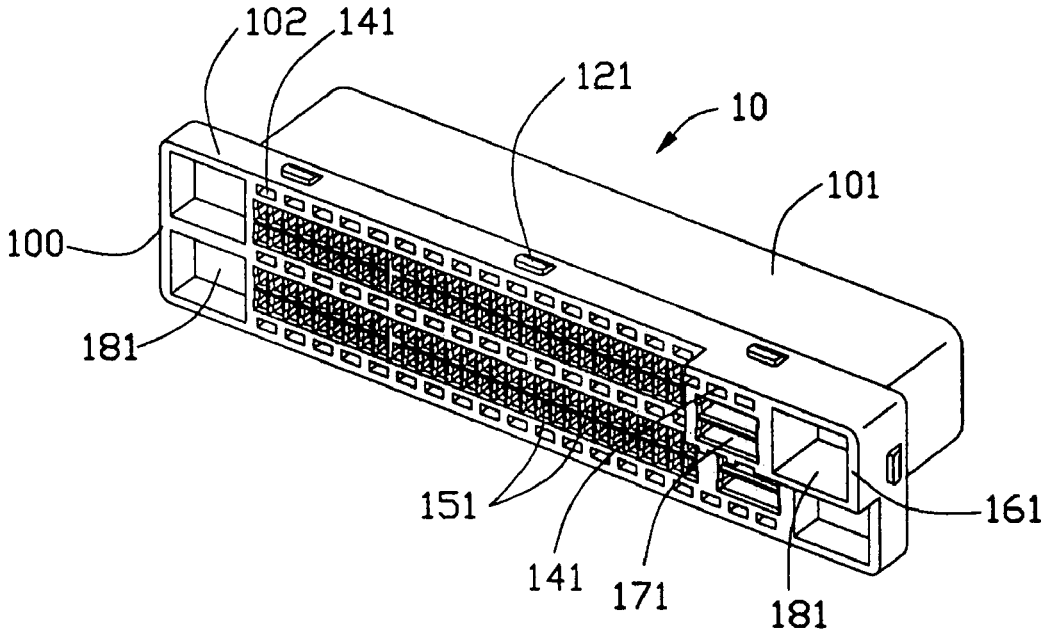
FIG. 4 is a view similar to FIG. 3, but taken from a rear aspect.

With reference to FIGS. 3 and 4 in conjunction with FIG. 2, the insulative housing 10 is elongated and comprises a base portion 100 and a rectangular mating portion 101 extending forwardly from the base portion 100. The base portion 100 has a rectangular body portion 102 and a protruding portion 161 extending rearwardly along a top surface from one side of the body portion 102. The body portion 102 provides a plurality of wedge-shaped tuber 121 formed in the periphery thereof. Additionally, the base portion 100 defines a plurality of large recesses 181 and small recesses 141 in a rear portion thereof for saving material. The mating portion 101 includes opposite top and bottom walls 112, and a pair of side walls 122 connecting with the top and the bottom walls 112. The top and the bottom walls 112 and the side walls 122 together define a receptacle 131 therebetween. An island 142 projects forwardly from the base portion 100 and is arranged in a middle of the receptacle 131. A plurality of narrow passageways 151 and wide passageways 171 are defined in the top and the bottom walls 112 and opposite side surfaces of the island 142, and extend through the base portion 100. The plurality of wide passageways 171 are disposed at one side of the plurality of narrow passageways 151. The receptacle 131 has a generally rectangular cross-section defining opposite first and second sides running longitudinally along the housing 10. The receptacle 131 has a pair of flattened corners 132 on the second side thereof so that the receptacle 131 is in fact hexagonal.

By flattening the corners of the receptacle 131, a polarization means is provided so that a complementary connector can be mated only in a given orientation. If the complementary connector is inverted 180 degrees, a mating portion of the complementary connector cannot be inserted into the receptacle 131 having flattened corners 132. Furthermore, the pair of flattened corners 132 is disposed in the mating receptacle 131 so that the polarization means cannot prolong the length of the electrical connector 1. It is noted that the polarization means is the pair of flattened corners 132 in the preferred embodiment. The invention, however, is not limited thereto. In fact, the polarization means of the prevent invention can be also a flatten corner 132, three flattened corners 132 or other similar structure without departing from the true spirit and scope of the invention as defined by the appended claims.

Figure 5:
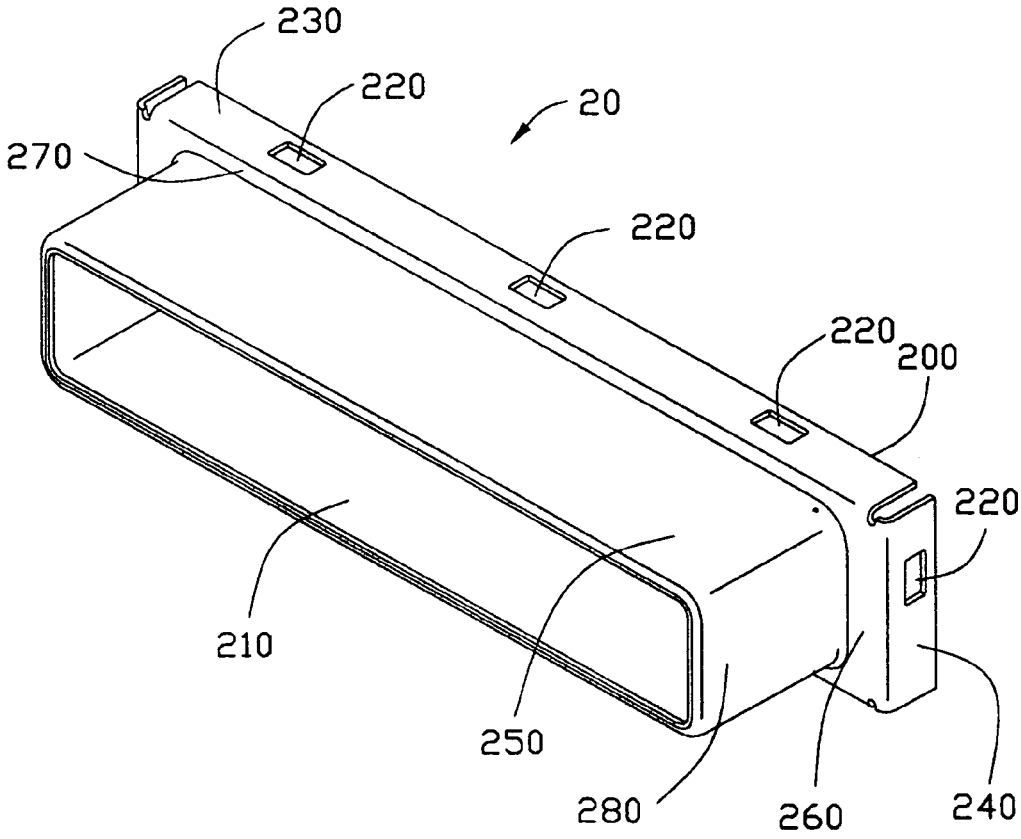
FIG. 5 is a perspective view of a shielding shell of FIG. 1.

Referring to FIG. 5, the shielding shell 20 comprises a frame 200 for covering on an outside surface of the base portion 100 of the insulative housing 10, and a rectangular casing 210 formed by drawing technology and attached to the mating portion 101. The frame 200 has a pair of longitudinal walls 230, a pair of transverse walls 240, and first and second connecting portions 260, 270. The longitudinal wall 230 connects with the casing 210 by the second connecting portion 270, and the transverse wall 240 connects with the casing 210 by the first connecting portion 260. A plurality of openings 220 are defined in the longitudinal walls 230 and the transverse wall 240 for interlocking with corresponding wedge-shaped tubers 121 of the insulative housing 10. The casing 210 includes a pair of opposite horizontal walls 250 for enclosing the top and the bottom walls 112 of the housing 10 and a pair of opposite vertical walls 280 connecting with the pair of the horizontal walls 250 for enclosing the pair of side walls 122 of the housing 10.

Figure 6:
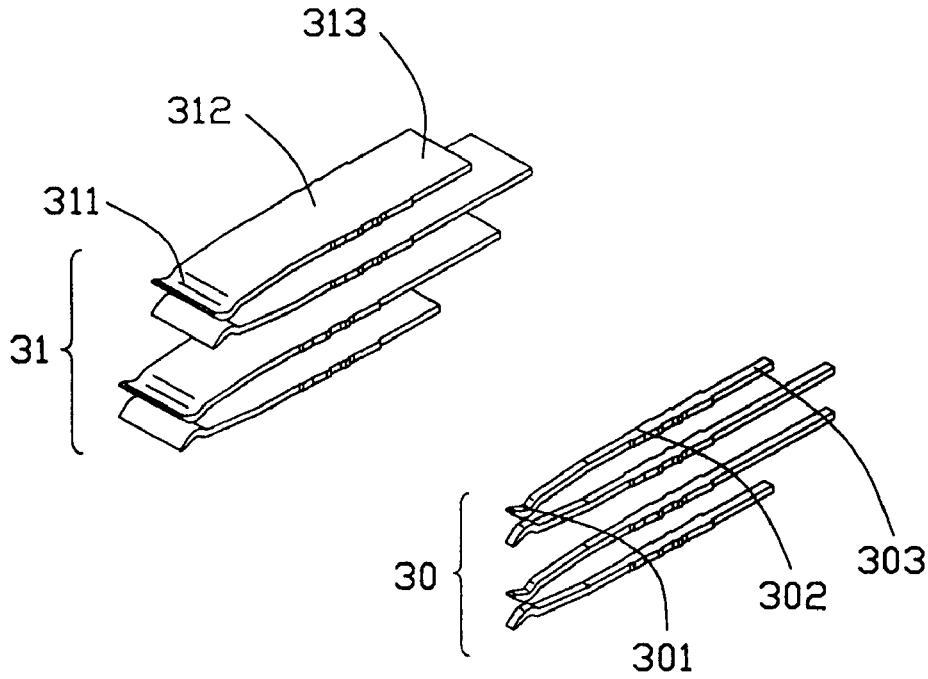
FIG. 6 is a perspective view of a plurality of contacts of FIG. 1.

Referring to FIG. 6, The first terminals 30 for transmitting signal are thin, while the second terminals 31 for transmitting power are wide. Each first/second terminal 30/31 comprises a first/second contacting portion 301/311 received in a corresponding narrow/wide passageway 151/171 of the housing 10 and projecting into the receptacle 131, a first/second tail portion 303/313 extending out of the base portion 100 of the housing 10, and a first/second retention portion 302/312 retained in the base portion 100 and connecting the first/second contact portion 301/311 and the first/second tail portion 303/313.

One of the features of the preferred embodiment of the invention provides an incomplete D-shaped interface for orientation of mating, which not only performs an anti-mismating function as the traditional D-shaped interface does, but also keep the right angle configuration of two of the four corners for aligning consideration. It is noted that the traditional D-shaped interface for the receptacle connector is essentially provided by the metallic shield. Another feature of the preferred embodiment of the invention is to provide a D-shaped interface, either the complete type or incomplete type, of the insulative housing for the receptacle type connector wherein the insulative housing defines a thin circumferential wall enclosing the D-shaped mating port having a mating tongue therein.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a mating portion with a receptacle defined therein, the receptacle having a generally rectangular cross-section defining opposite first and second sides running longitudinally along the housing;

a plurality of conductive terminals mounted in the housing with contact portions of the terminals projecting into the receptacle; and polarization means disposed in the receptacle for only allowing a complementary connector in a given orientation to insert into the receptacle, and including a pair of flattened corners on either of the first and the second sides of the receptacle;

wherein said mating portion has a rectangular outline and said receptacle is hexagonal;

wherein said housing has an island projecting from the receptacle;

wherein said housing comprises a top wall, an opposite bottom wall and a pair of side walls connecting the top and the bottom wall, which together define said receptacle therebetween;

wherein a plurality of passageways are defined in the top wall, the bottom wall, and opposite side surfaces of the island for receiving said terminals;

wherein said housing comprises a base portion and said mating portion projects forwardly from the base portion;

wherein the housing further comprising a shielding shell attached to the housing, and includes a frame for covering the base portion of the housing, and a rectangular casing extending forwardly from the frame for encircling the mating portion.

2. The electrical connector as claimed in claim 1, wherein said terminals has first and second terminals, and said passageways has first passageways and second passageways located at one side of the first passageways receptively receiving corresponding first and second terminals.

3. The electrical connector as claimed in claim 1, wherein said base portion provides a plurality of wedged-shaped tubers and said frame defines a plurality of openings for engaging with corresponding tubers.

4. An electrical connector comprising:

an insulative housing having a mating portion with a receptacle defined in a circumferential wall, the circumferential wall defining a cross-section essentially including at least four sides;

a plurality of conductive terminals mounted in the housing with contact portions of the terminals projecting into the receptacle; and a polarization structure disposed in the receptacle for only allowing a complementary connector in a given orientation to insert into the receptacle, and including at least one inwardly facing oblique surface formed on an inner surface of said circumferential wall; wherein a metallic frame type shield encloses the mating portion and defines a rectangular cross-sections;

wherein said housing includes a mating tongue with contacting portions thereon;

wherein some of the terminals are located in the circumferential wall.

* * * * *